US009661926B2

(12) United States Patent
Friesenecker et al.

(10) Patent No.: US 9,661,926 B2
(45) **Date of Patent: *May 30, 2017**

(54) PULL-OUT GUIDE FOR DRAWERS

(75) Inventors: Gerald Friesenecker, Lauterach (AT); Ulrich Greussing, Bizau (AT)

(73) Assignee: Julius Blum GmbH, Hoechst (AT)

( * ) Notice: Subject to any disclaimer, the term of this patent is extended or adjusted under 35 U.S.C. 154(b) by 704 days.

This patent is subject to a terminal disclaimer.

(21) Appl. No.: 13/593,577

(22) Filed: Aug. 24, 2012

(65) Prior Publication Data

US 2013/0002115 A1 Jan. 3, 2013

Related U.S. Application Data

(63) Continuation of application No. PCT/AT2011/000068, filed on Feb. 7, 2011.

(30) Foreign Application Priority Data

Feb. 25, 2010 (AT) ..... 288/2010

(51) Int. Cl.
*A47B 88/493* (2017.01)

(52) U.S. Cl.
CPC ..... *A47B 88/493* (2017.01); *A47B 2210/007* (2013.01); *A47B 2210/0013* (2013.01)

(58) Field of Classification Search
CPC ..... A47B 88/493; A47B 2210/0013; A47B 2210/007
USPC ..... 312/334.6, 331, 334.9, 334.12, 334.13, 312/334.14, 334.15, 334.18; 384/18, 19, 384/51, 53, 57
See application file for complete search history.

(56) References Cited

U.S. PATENT DOCUMENTS 1,067,404 A * 7/1913 Callaghan ..... 312/331
3,124,401 A * 3/1964 McClellan ..... 312/334.13
3,687,505 A * 8/1972 Fall et al. ..... 384/18
(Continued)

FOREIGN PATENT DOCUMENTS

AT 360 699 1/1981
AT 388 855 9/1989
(Continued)

OTHER PUBLICATIONS

CN201282850Y Translation.*
(Continued)

*Primary Examiner* — Andrew Roersma
(74) *Attorney, Agent, or Firm* — Wenderoth, Lind & Ponack, L.L.P.

(57) ABSTRACT

A pull-out guide for drawers has a carcass rail, a drawer rail, and a central rail which is moveably mounted between the carcass rail and the drawer rail. At least one carriage is mounted in a moveable manner between at least two rails of the pull-out guide. A synchronization apparatus avoids running faults of the pull-out guide, and the synchronization apparatus has at least one synchronization wheel which interacts firstly with the one carriage and secondly with a running surface which is arranged on one of the rails. The synchronization wheel is in the form of a gear with two pinions with different diameters. The first pinion and the second pinion are connected to one another in a rotationally fixed manner, wherein, when one pinion moves, the other pinion also moves.

12 Claims, 6 Drawing Sheets

(56) References Cited

U.S. PATENT DOCUMENTS

| | | | | |
|---|---|---|---|---|
| 3,857,618 | A | 12/1974 | Hagen et al. | |
| 4,470,642 | A * | 9/1984 | Gasperin | 384/19 |
| 5,421,648 | A * | 6/1995 | Grabher | 312/331 |
| 5,769,518 | A * | 6/1998 | Grabher | 312/334.6 |
| 2003/0189395 | A1 | 10/2003 | Doornbos et al. | |
| 2004/0104649 | A1 | 6/2004 | Muller et al. | |
| 2004/0222682 | A1 | 11/2004 | Salice | |
| 2010/0045153 | A1* | 2/2010 | Ritter | 312/334.1 |
| 2013/0127320 | A1* | 5/2013 | Greussing | 312/334.44 |

FOREIGN PATENT DOCUMENTS

| | | | |
|---|---|---|---|
| CN | 201282850 | 8/2009 | |
| CN | 201299316 | 9/2009 | |
| DE | 20 18 671 | 10/1971 | |
| DE | 41 11 750 | 10/1992 | |
| DE | 10 2004 002 823 | 8/2005 | |
| DE | 10 2005 016 418 | 11/2005 | |
| EP | 1 393 654 | 8/2006 | |
| EP | 1 374 734 | 8/2007 | |
| TW | 200425861 | 12/2004 | |
| WO | WO2008134782 A1 * | 11/2008 | A47B 88/10 |

OTHER PUBLICATIONS

CN201299316Y Translation.*
DE2018671A1 Translation.*
DE102005016418A1 Translation.*
DE102004002823 Translation.pdf.*
International Search Report issued Jun. 29, 2011 in International (PCT) Application No. PCT/AT2011/000068.
Austrian Patent Office Search Report completed Dec. 15, 2010 in Austrian Patent Application No. A 288/2010.

* cited by examiner

PULL-OUT GUIDE FOR DRAWERS

This application is a Continuation of International Application No. PCT/AT2011/000068, filed Feb. 7, 2011, the entire disclosure of which is incorporated herein by reference.

BACKGROUND OF THE INVENTION

The present invention concerns an extension guide for drawers comprising a carcass rail to be fixed to a furniture carcass, a drawer rail to be fixed to the drawer and a central rail mounted movably between the carcass rail and the drawer rail. At least one running carriage is mounted displaceably between at least two rails of the extension guide, and a synchronization device for avoiding running faults of the extension guide is provided. The synchronization device has at least one synchronization wheel which co-operates on the one hand with the at least one running carriage and on the other hand with a running surface on one of the rails, and the synchronisation wheel is in the form of a gear having two pinion wheels of differing diameters.

The invention further concerns an article of furniture having at least one drawer which is mounted displaceably relative to a furniture carcass by way of an extension guide of the kind to be described.

In extension guides for drawers which are in the form of a full pull-out extension arrangement comprising a carcass rail, a drawer rail, and a central rail operative therebetween, a synchronization device is to be provided to avoid running faults in respect of the extension guide. Such running faults are both incorrect rail positions and also incorrect positions of the running carriage, which in normal use can lead to the drawer staying open. An incorrect rail position occurs, for example, if the drawer rail deviates from synchronous movement relative to the displaceable central rail, whereby the relative position of the rails in relation to each other is not correct. In contrast, running carriage faults denote incorrect positioning of the running carriage which builds up over an opening and closing movement and which are determined by the built-up difference in relation to the correct starting position. A fault of the running carriage can build up in particular due to slippage or because of elasticity in the rolling or running system during the operating movements. As from a given number of movements the carriage can be so far from its required position that it encounters an end-of-travel abutment in the rail system before the drawer is at all completely closed.

Extension guides frequently have a pull-in device with a damper which damps the pull-in movement of the drawer over the last closing range of movement of the drawer as far as the completely closed position. Those dampers, however, reduce the closing dynamics of the drawer in such a way that a running fault which has occurred during the movement of the drawer can no longer be compensated due to the lack of kinetic energy. In any additional movement in which the drawer is not completely opened, the drawer remains stopped in a further open position corresponding to the running fault, and that can be visually unattractive and also dangerous.

Numerous solutions have already been proposed for correcting or avoiding such incorrect movements of the rails and/or the running carriage. A running carriage synchronization arrangement is described, for example, in AT 360 699 B to the present applicant, wherein the running carriage which is mounted displaceably between the carcass rail and the central rail and the running carriage which is displaceable between the central rail and the drawer rail are positively controlled relative to each other by way of a gear mounted to the central rail.

A rail synchronization arrangement is described for example in AT 388 855 B, wherein the operating movements of the rails are controlled by way of a gear in engagement with tooth portions arranged on the rails.

EP 1 374 734 A proposes a drawer guide which has both a synchronization device for synchronization of the carriages and also an additional compensation device for compensating a synchronous running fault in respect of the rails.

DE 10 2005 016 418 A1 discloses a drawer extension guide having a synchronization device, wherein the synchronization wheel has two pinion wheels of differing diameters. The smaller pinion wheel controls the movement of the drawer rail relative to the carcass rail while the larger pinion wheel always controls the movement between two carriages which run between different pairs of rails. The two pinion wheels are mounted on a common shaft, but they run separately and independently of each other so that there is no synchronization between the two pinion wheels.

SUMMARY OF THE INVENTION

The object of the present invention is to propose a drawer extension guide having a synchronization device of the general kind referred to in the opening part of this specification, which has a simple structure and which substantially avoids the running faults addressed.

According to the invention, the object is attained by the features described below. Further advantageous configurations of the invention are also described.

According to the invention, therefore, that the first pinion wheel and the second pinion wheel are connected together in a torque-proof manner, wherein upon a movement of one pinion wheel the other pinion wheel also moves therewith.

In other words, the proposed synchronization device can provide a direct coupling between a movable rail and a running carriage. While in conventional solutions, the rails and the carriages were respectively controlled relative to each other, the present invention is founded on the basic concept of providing a synchronization device for at least temporary coupling between at least one rail and at least one carriage of the drawer extension guide.

In conventional rail control arrangements, toothed racks are arranged or formed on both rails. According, to the invention, however, the arrangement of a single rack at one of the rails is sufficient so that the number of components can be reduced.

The synchronization wheel can either be in the form of a pinion or gear co-operating with a corresponding running surface on a rail of the extension guide. In that case, the running surface can either be the running limb of a rail or alternatively it can be in the form of a tooth arrangement which is arranged or formed on the rails and on which the gear can run. An advantage of the rack-and-pinion arrangement is positively locking and slippage-free synchronization, while a compact arrangement on the extension guide is possible. It is also possible for the running surface of the rail—on which the synchronization wheel runs—to be formed directly in the rail material, in which case the running surface is formed in the rails (for example in the form of grooving) and extends in the pull-out direction of the rails.

In an embodiment of the invention, the synchronization wheel is mounted rotatably to the central rail—preferably at a horizontal shaft. In this connection, it may be advantageous if the synchronization wheel passes through the central rail at an opening, wherein the synchronisation wheel on one side of the opening co-operates with the carriage and on the other side of the opening co-operates with one of the rails.

In a structurally simple configuration, the synchronization wheel is in the form of a gear which meshes on the one hand with a tooth arrangement on the carriage and on the other hand with a tooth arrangement on a rail. The gear includes two pinion wheels of differing diameters, wherein a first pinion wheel meshes with the carriage and a second pinion wheel meshes with a rail. The first pinion wheel can be mounted on one side of the central rail and the second pinion wheel can be mounted on an opposite second side of the central rail. In a development of the invention, the two pinion wheels can be mounted on a common, preferably horizontal axis. The first and second pinion wheels are non-rotatably connected together so that, upon a movement of one pinion wheel, the other pinion wheel also moves therewith.

A particular advantage of the invention lies in the possibility of providing a transmission ratio between the drawer rail and the central rail by virtue of differing diameters of the pinion wheels in order to influence the travel lengths to be covered by those rails. Thus, it is for example possible for the extension travel of the drawer rail to be set at 55% and for the extension travel of the central rail to be correspondingly set at 45%. In a possible configuration, the extension travel of the drawer rail can be selected to be between 50% and 60%, and the extension travel of the central rail can be correspondingly selected to be between 50% and 40%. In the case of a drawer extension guide, the lower region (namely the carcass rail, the central rail, and the carriage mounted between those rails) is usually considerably loaded. That loaded region is moved less by virtue of a reduction in the travel length, brought about by the transmission ratio, and that overall reduces the frictional resistance in the extension guide. In addition, due to the shorter extension length of the central rail, the running carriage which is mounted between the carcass rail and the central rail can also be of a greater longitudinal extent, thereby affording more advantageous lever ratios and more uniform force distribution.

In a preferred embodiment of the invention, the running carriage to be synchronized is mounted displaceably between the carcass rail, and the central rail and the synchronization wheel co-operates with the drawer rail. In that way, upon manual movement of the drawer, the force is applied from the drawer rail directly to the rail control arrangement, wherein the running carriage which is mounted between the carcass rail and the central rail, the central rail and the drawer rail are synchronized. By virtue of the fact that, in that design configuration, the drawer rail always assumes a defined relative position with respect to the central rail, it is even possible to dispense with synchronization of the upper running carriage (that is to say the running carriage mounted between the central rail and the carcass rail). It will be appreciated, however, that it is also possible to provide a control device known from the state of the art, for avoiding and/or correcting the running carriage faults.

The running carriage or carriages displaceable between the rails has or have at least one or more rolling bodies which are provided for transmitting the load of the drawer. The rolling body or bodies can include rollers, cones, cylindrical rolls, disks and/or balls.

The article of furniture according to the invention has at least one drawer which is mounted displaceably relative to a furniture carcass by way of an extension guide of the kind in question.

BRIEF DESCRIPTION OF THE DRAWINGS

Further details and advantages of the present invention will be described by means of the specific description hereinafter. In the drawings.

DETAILED DESCRIPTION OF THE INVENTION

Figure 1:
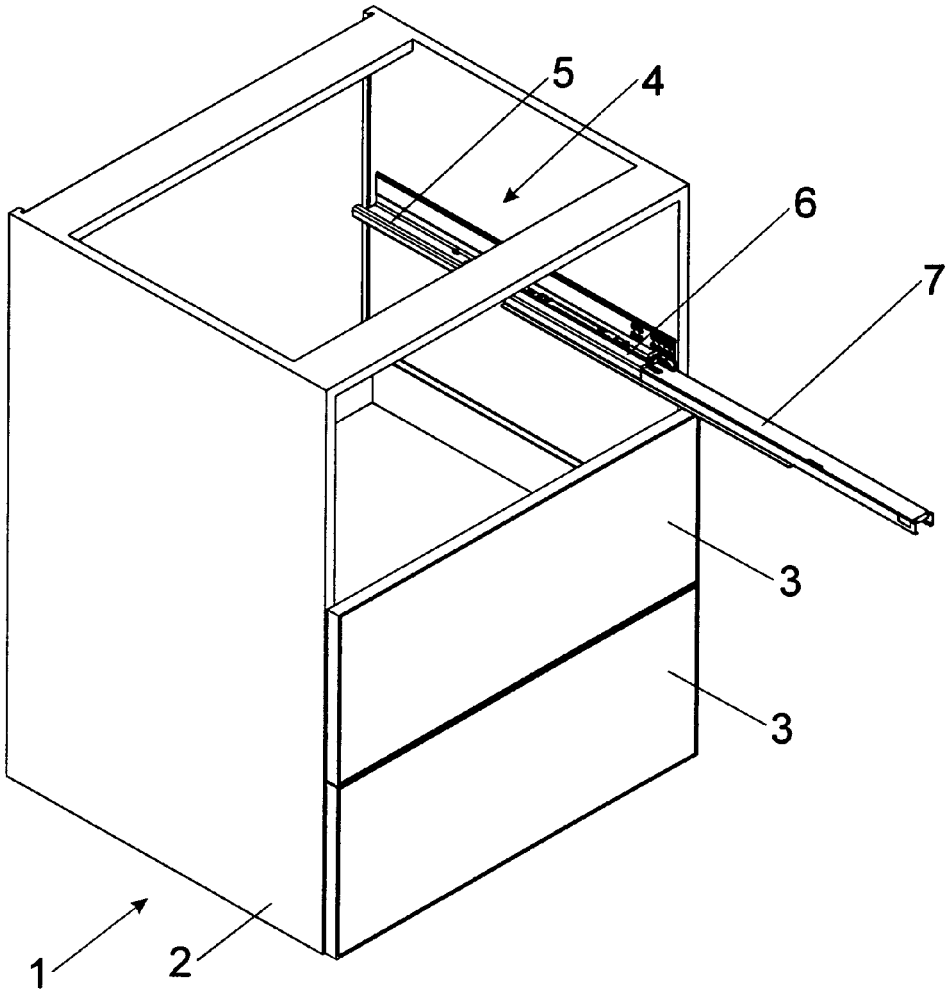
FIG. 1 is a perspective view of an article of furniture with drawers which are mounted displaceably relative to a furniture carcass by way of drawer extension guides.

FIG. 1 shows a perspective view of an article of furniture 1, wherein drawers 3 are mounted displaceably relative to a furniture carcass 2 by way of drawer extension guides 4. In the illustrated embodiment, the drawer extension guide 4 is in the form of a full pull-out extension guide arrangement and has a carcass rail 5 to be fixed to the furniture carcass 2, a central rail 6 displaceable relative to the carcass rail 5, and a drawer rail 7 which can be pulled out. The drawer rail 7 is to be connected to a respective one of the drawers 3. Arranged between the carcass rail 5 and the central rail 6 is at least one first displaceable running carriage and arranged between the central rail 6 and the drawer rail 7 is at least one second displaceable running carriage (which, however, cannot be seen in the illustrated Figures). The running carriages have rolling bodies for transmitting the load of the drawer 3. A synchronization device according to the invention makes it possible to prevent incorrect movements of the rails 6, 7 and/or incorrect movements of a running carriage mounted displaceably between the rails 5, 6, 7.

Figure 2:
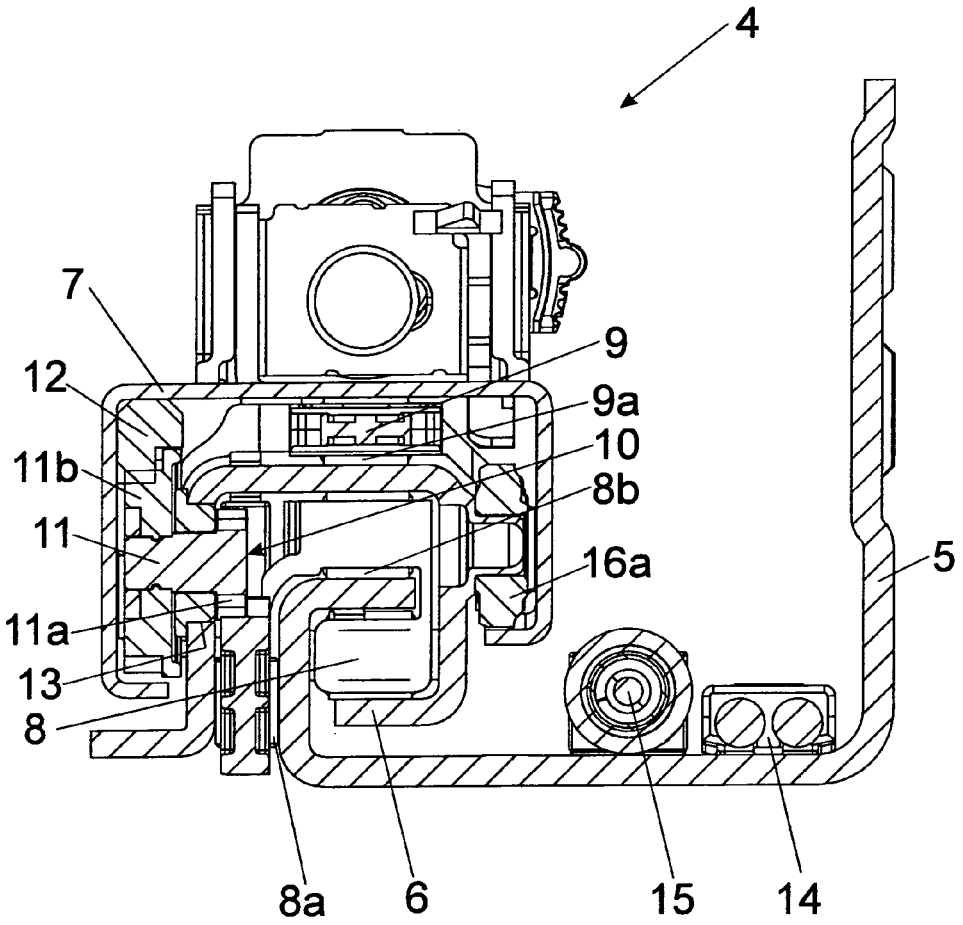
FIG. 2 shows a cross-section of the drawer extension guide.

FIG. 2 shows a cross-section of the extension guide 4, wherein the carcass rail 5 to be fixed to the furniture carcass 2, the central rail 6 which is displaceable relative to the carcass rail 5, and the drawer rail 7 to be connected to the drawer 3 can be seen here. Mounted displaceably between the carcass rail 5 and the central rail 6 is at least a first running carriage 8 which embraces a horizontal limb of the carcass rail 5. At least one second running carriage 9 is mounted displaceably between the central rail 6 and the drawer rail 7. The first running carriage 8 has rolling bodies 8*a*, 8*b* and the second running carriage 9 has at least one rolling body 9*a* for transmitting the load of the drawer 3. To avoid incorrect movements of the rails 5, 6, 7 and/or the running carriages 8, 9, the extension guide 4 has a synchronization device 10 with a synchronization wheel 11 which synchronizes at least one of the movable rails 6, 7 with at least one of the two carriages 8, 9. In the illustrated embodiment, a relative movement between the first (lower) running carriage 8 and the drawer rail 7 is synchronized. In the illustrated configuration, it is also possible that the upper running carriage 9 can remain uncontrolled as, due to the positive control of the other moved components, it scarcely deviates from its target position and thus synchronization of the upper running carriage 9 is not absolutely necessary.

The synchronization wheel (gear) 11 of the synchronization device 10 can be in the form of a gear which meshes on the one hand with the lower running carriage 8, and on the other hand with a running surface 12 which is arranged or formed on the drawer rail 7—in the present case with a toothed bar mounted to the drawer rail 7. In the illustrated embodiment, the gear 11 is in the form of a double-stage gear 11 with pinion wheels 11*a* and 11 *b* which are of differing diameters. The smaller (first) pinion wheel 11*a* meshes with the lower running carriage 8 while the larger (second) pinion wheel 11*b* meshes with the running surface 12 in the form of the toothed bar. The synchronization wheel 11 is mounted rotatably to the central rail 6 and passes through the central rail 6 at an opening 13 provided on the central rail 6 so that the smaller (first) pinion wheel 11*a* co-operates with the running carriage 8 on one side of the opening 13 and the larger (second) pinion wheel 11*b* co-operates with the running surface (toothed bar) 12 of the drawer rail 7 on the other side of the opening 13. The extension guide also has a spring-assisted pull-in device 14 for pulling the drawer 3 into the closed end position and a damping device 15 which damps that pulling-in movement of the drawer 3 in the last closing region of movement towards the fully closed position.

Figure 3:
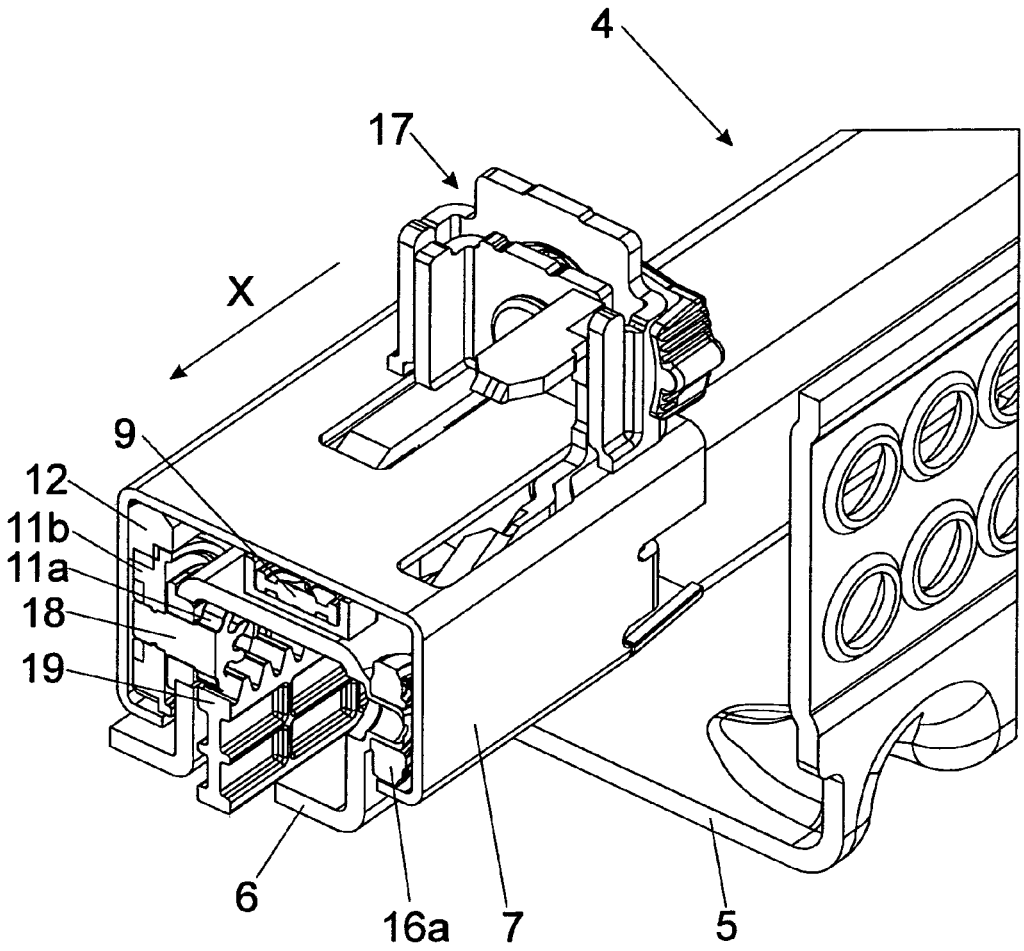
FIG. 3 is a perspective sectional view of the drawer extension guide.

FIG. 3 shows a perspective view in cross-section of the drawer extension guide 4, wherein the drawer rail 7 which is displaceable in the extension direction X is in the completely open position. In the rear end region, the drawer rail 7 has a mounting element 17 which is known in the state of the art and which is provided as a push-in limiting means for the drawer 3 upon fitment to the drawer extension guide 4 and for positional adjustment of the rear region of the drawer 3 so that the external appearance of the gaps between the drawers 3 is adjustable. Fixed to the underside of the drawer rail 7 is the running surface 12 in the form of a toothed bar 12*a* which from the rear end region of the drawer rail 7 in the extension direction X thereof can extend over more than half the length of the drawer rail 7. Mounted rotatably to the central rail 6 is the second pinion wheel 11*b* meshing with the toothed bar 12 of the drawer rail 7. The second pinion wheel 11*b* is mounted to a horizontal shaft 18 which passes through the central rail 6. Also mounted to the shaft 18 is the smaller first pinion wheel 11*a* meshing with a rack 19 of the lower carriage 8. It is also possible to see the upper running carriage 9 which is mounted displaceably between the central rail 6 and the drawer rail 7 and the support roller 16*a* mounted rotatably to the central rail 6.

Figure 4A:
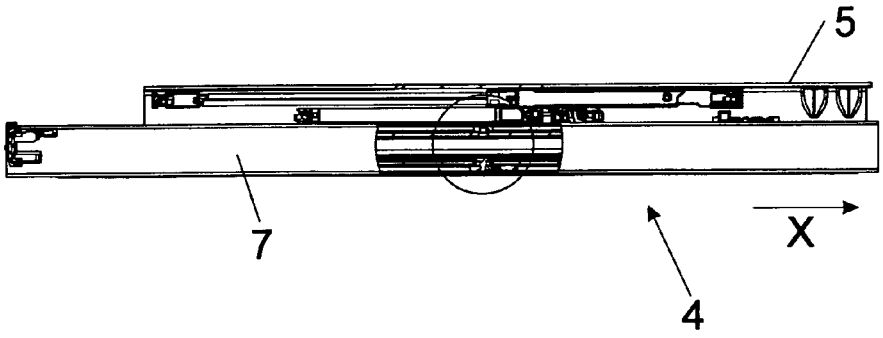
FIGS. 4*a*, 4*b* is a plan view of the drawer extension guide and a detail view thereof on an enlarged scale.
Figure 4B:
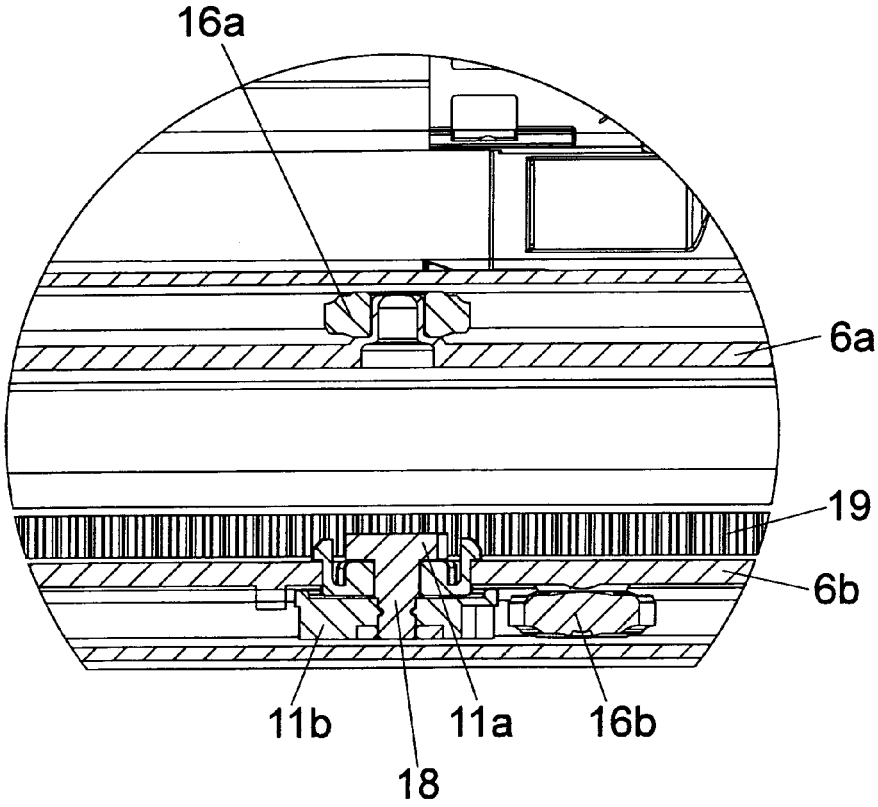

FIG. 4*a* shows a plan view of the extension guide 4 with the carcass rail 5 and the drawer rail 7 displaceable in the extension direction X, while FIG. 4*b* shows a view on an enlarged scale of the detail marked in FIG. 4*a* (that is to say, a horizontal section through the extension guide 4). The central rail 6 has vertical limbs 6*a* and 6*b*, at the outsides of which respective support rollers 16*a*, 16*b* are mounted rotatably to the central rail 6. The smaller first pinion wheel 11*a* meshes with the tooth rack arrangement 19 of the running carriage 8 (but not with the toothed bar 12). The larger second pinion wheel 11*b* is non-rotatably connected to the smaller pinion wheel 11*a* by way of a shaft 18 and meshes with the running surface 12 (toothed bar), shown in FIG. 3, of the drawer rail 7 (but not with the toothed rack arrangement 19).

Figure 5:
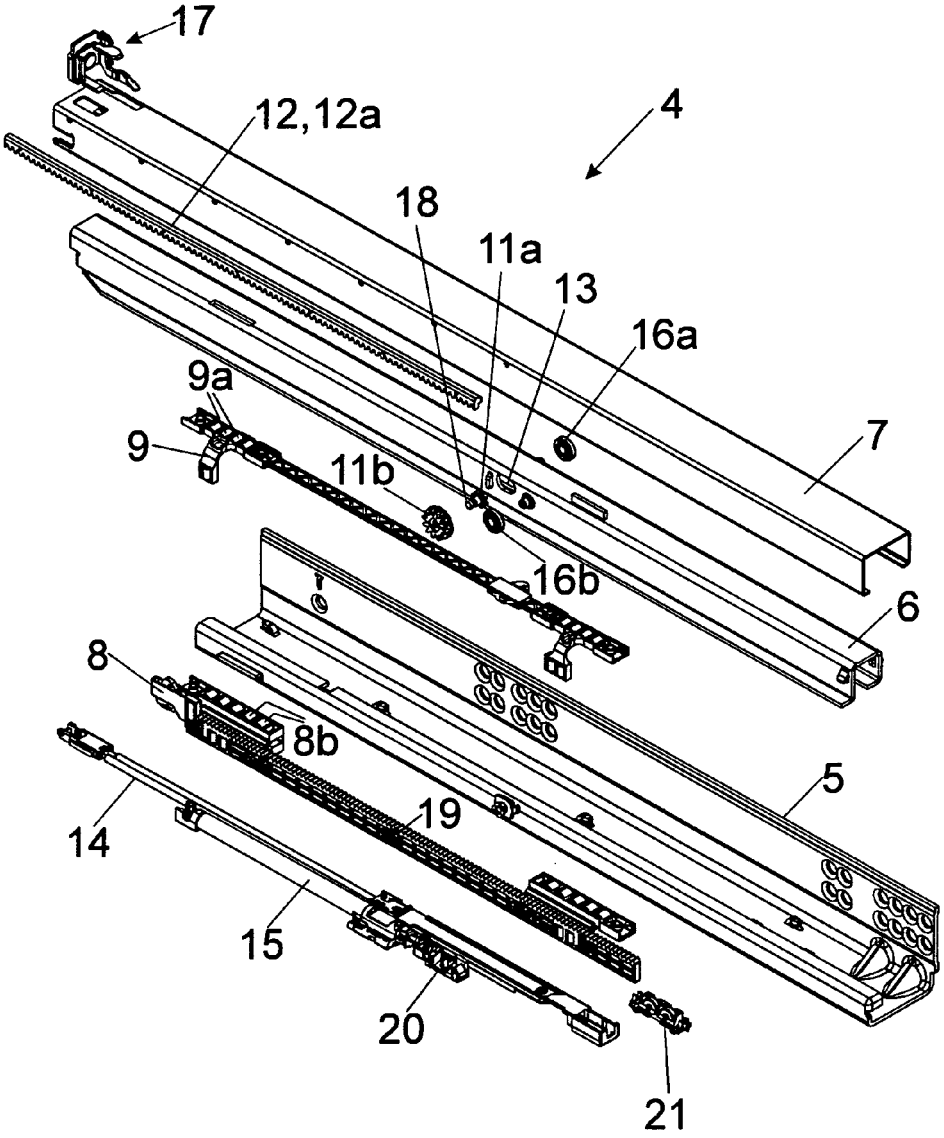
FIG. 5 is an exploded view of the drawer extension guide.

FIG. 5 shows an exploded view of the drawer extension guide 4. The first running carriage 8 with load-transmitting rolling bodies 8*b* is mounted displaceably between the carcass rail 5 and the central rail 6. The second running carriage 9 with load-transmitting rolling bodies 9*a* is mounted displaceably between the central rail 6 and the drawer rail 7. The central rail 6 has a lateral opening 13 through which the shaft 18 passes. A pinion wheel 11 meshing with the tooth arrangement 19 of the lower running carriage 8 is arranged or formed on the shaft 18. Also mounted on the shaft 18 is the larger second pinion wheel 11*b* co-operating with a running surface 12 of the drawer rail 7—in the present case with a toothed bar 12*a*. A pull-in device 14 having a spring-loaded entrainment member 20 which can be releasably coupled to the drawer rail 7 is provided for pulling the drawer rail 7 into the closed end position. For damping that pull-in movement there is a damping device 15 which in the illustrated embodiment is in the form of a fluid damper comprising a piston-cylinder unit. Finally, there is also a mounting block 21 which is to be mounted to the carcass rail 5 and has support rollers at which the drawer rail 7 can be supported.

Figure 6:
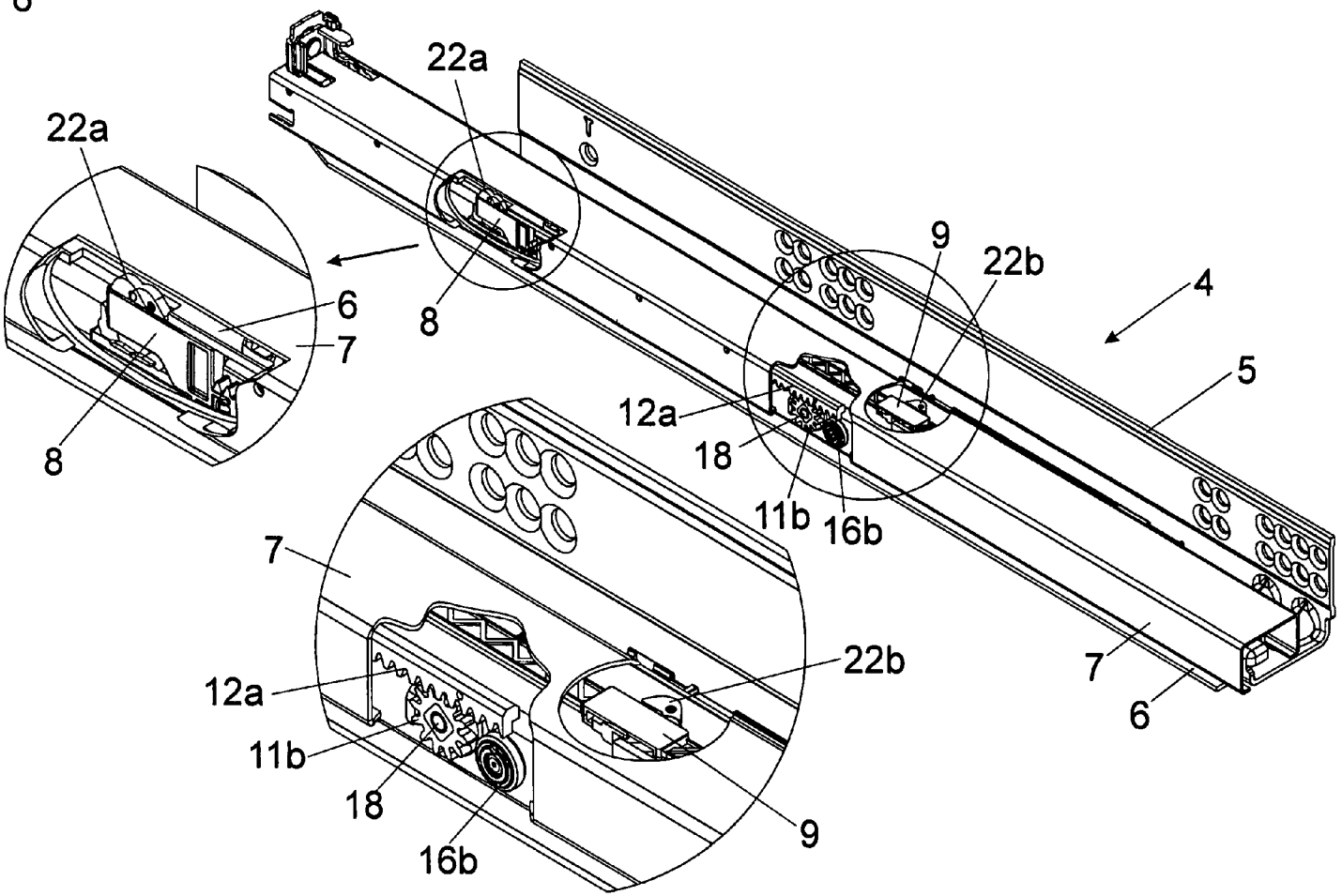
FIG. 6 is a partly broken-away perspective view of the drawer extension guide.

FIG. 6 shows a partly broken-away view with enlarged detail views of the drawer extension guide 4 having a carcass rail 5, a central rail 6 and a drawer rail 7. The rack (toothed bar) 12*a* arranged at the underside of the drawer rail 7 is clearly visible. The toothed bar 12*a* is invisible from the exterior, in which respect it is also possible to reduce fouling. The second pinion wheel 11*b* mounted to the shaft 18 can run on the rack 12*a*. That movement which is applied to the second pinion wheel 11*b* is applied directly to the lower running carriage 8 by way of the shaft 18 and the first pinion wheel 11*a* (not visible here). In the illustrated embodiment, both running carriages 8, 9 have a respective control device 22*a* and 22*b*, by which the running carriage or carriages 8, 9 can be temporarily arrested in the event of possible incorrect positioning at predetermined locations at one of the rails 5, 6, 7 of the drawer extension guide 4. That arresting action can be released again by displacement of the rails 5, 6, 7 relative to each other so that after release of the arresting action the running carriages 8, 9 are movable beyond the predetermined locations in the direction of the end positions of the running carriages 8, 9. A possible way of eliminating those incorrect running carriage positions is described in EP 1 393 654 B1 to the present applicant so that the mode of operation of those control devices 22*a*, 22*b* does not have to be described in closer detail at this juncture.

The present invention is not limited to the illustrated embodiments but includes or extends to all variants and technical equivalents which can fall within the scope of the claims appended hereto. The positional references adopted in the description such as for example up, down, lateral and so forth are also related to the usual installation position of the components used and to the illustrated Figure and are to be appropriately transferred to the new position upon a change in position.

The invention claimed is:

1. An extension guide for a drawer, comprising:

a carcass rail to be fixed to a furniture carcass;

a drawer rail to be fixed to the drawer;

a central rail mounted movably between said carcass rail and said drawer rail, one of said carcass rail, said drawer rail, and said central rail having a running surface comprising a toothed bar;

a running carriage mounted displaceably between two of said carcass rail, said drawer rail, and said central rail, said running carriage having a toothed rack; and a synchronization device for preventing running faults of said extension guide, said synchronization device including a synchronization wheel formed of a gear having a first pinion wheel and a second pinion wheel having different diameters, said first pinion wheel meshing with only said toothed rack of said running carriage without meshing with said toothed bar or any other racks or bars, and said second pinion wheel meshing with only said toothed bar without meshing with said toothed rack of said running carriage or any other racks or bars, each of said first pinion wheel and said second pinion wheel being mounted to said central rail such that said first pinion wheel and said second pinion wheel are separated from each other by a portion of said central rail located therebetween;

wherein said first pinion wheel and said second pinion wheel are connected together in a torque-proof manner such that a movement of one of said first pinion wheel or said second pinion wheel causes the other of said first pinion wheel and said second pinion wheel to move therewith.

2. The extension guide according to claim 1, wherein said synchronization wheel is mounted to said central rail, and said drawer rail has said running surface comprising said toothed bar.

3. The extension guide according to claim 1, wherein said synchronization wheel is rotatably mounted to a horizontal shaft.

4. The extension guide according to claim 1, wherein said central rail has an opening, said synchronization wheel passing through said opening in said central rail, said synchronization wheel being configured to co-operate with said toothed rack of said running carriage at a first side of said opening and to co-operate with said toothed bar of said running surface at a second side of said opening.

5. The extension guide according to claim 1, wherein said first pinion wheel and said second pinion wheel are mounted on a common shaft.

6. The extension guide according to claim 1, wherein said running carriage is mounted displaceably between said carcass rail and said central rail.

7. The extension guide according to claim 1, wherein said running surface is on said drawer rail.

8. An article of furniture comprising:

a furniture carcass;

said extension guide according to claim 1; and a drawer mounted displaceably relative to said furniture carcass via said extension guide.

9. The extension guide according to claim 1, wherein said running carriage comprises a first running carriage mounted displaceably between said carcass rail and said central rail, said extension guide further comprising a second running carriage mounted displaceably between said central rail and said drawer rail.

10. The extension guide according to claim 1, wherein said first pinion wheel and said second pinion wheel are mounted on a common shaft extending through said central rail, said first pinion wheel being located on a first end of said shaft at a first side of said portion of said central rail, and said second pinion wheel being located on a second end of said shaft at a second side of said portion of said central rail.

11. The extension guide according to claim 10, wherein said portion of said central rail is a vertical limb, and said shaft is a horizontal shaft extending through said vertical limb.

12. The extension guide according to claim 1, wherein said running carriage has a plurality of horizontal rolling bodies and a plurality of vertical rolling bodies.

* * * * *